United States Patent [19]

Chambonnet

[11] Patent Number: 4,798,202

[45] Date of Patent: Jan. 17, 1989

[54] COMPRESSED-AIR BREATHING APPARATUS FOR UNDERWATER DIVING

[75] Inventor: Bernard Chambonnet, Vence, France

[73] Assignee: La Spirotechnique Industrielle et Commerciale, Carros Cedex, France

[21] Appl. No.: 13,876

[22] Filed: Feb. 12, 1987

[30] Foreign Application Priority Data

Feb. 21, 1986 [FR] France ..... 86 02367

[51] Int. Cl.[4] ..... A62B 7/04

[52] U.S. Cl. ..... 128/204.26; 128/204.25; 137/494

[58] Field of Search ..... 128/204.25, 204.26, 128/204.18, 204.29; 137/494, 908

[56] References Cited

U.S. PATENT DOCUMENTS

| | | | |
|---|---|---|---|
| 2,728,340 | 12/1955 | Meidenbauer | 128/204.26 |
| 2,893,386 | 7/1959 | Sajeck . | |
| 3,362,429 | 1/1968 | Volsk | 128/204.26 X |
| 4,041,977 | 8/1977 | Matsuno | 128/204.26 X |
| 4,266,538 | 5/1981 | Ruchtl | 128/204.26 |
| 4,446,859 | 5/1984 | Pedersen | 128/204.26 |
| 4,467,797 | 8/1984 | Franke | 128/204.26 |
| 4,572,175 | 2/1986 | Flynn | 128/204.26 X |
| 4,616,645 | 10/1986 | Pedersen et al. | 128/204.26 |
| 4,683,881 | 8/1987 | Hansen et al. | 128/204.26 |

*Primary Examiner*—Kyle L. Howell
*Assistant Examiner*—Angela D. Sykes
*Attorney, Agent, or Firm*—Young & Thompson

[57] ABSTRACT

A compressed air breathing apparatus, in particular for underwater diving, comprising a compressed air supply (1) communicating with a chamber (15) for expanding the compressed air, through a valve (6,7,2,10,13,3,14) whose opening and closing are controlled by a diaphragm (4) responsive to the inhaling effort on the part of the user, and a mouthpiece (22) comprising a conduit (21) which puts the expansion chamber (15) in communication with the mouth of the user. According to the invention, the conduit (21) of the mouthpiece (22) includes a tongue (5) for forming an obstacle to the free flow of the air from the expansion chamber (15) to the mouth of the user, the tongue (5) being so arranged that the depression required for opening the valve is between −6 millibars and +6 millibars for a rate of flow of 400 liters/min. The tongue (5) is adjustable as to position to vary the extent to which it impedes free flow of the air.

9 Claims, 4 Drawing Sheets

COMPRESSED-AIR BREATHING APPARATUS FOR UNDERWATER DIVING

BACKGROUND OF THE INVENTION

The present invention relates to the compressed-air breathing apparatus in particular for underwater diving comprising compressed air supply means communicating with a compressed-air expansion chamber through a valve the opening and closing of which are controlled by means responsive to the inhaling effort of the user, and a mouthpiece including a conduit which puts the expansion chamber in communication with the mouth of the user.

Modern compressed-air breathing apparatus are generally of the type having two expansion stages. The compressed air of the cylinders carried by the diver is expanded first of all from a high pressure (about 200 bars) to a pressure termed an intermediate pressure (about 9 bars) by a pressure-reducing valve fixed to said cylinders. This air at intermediate pressure is supplied through a flexible pipe to a second stage which is connected to the mouth of the diver by the mouthpiece.

In this second stage, the air is expanded from the intermediate pressure to the ambient pressure by a mechanism actuated by the depression created by an air demand on the part of the diver. The air flow delivered by the second stage as a function of the depression applied thereto by the air demand on the part of the diver characterises the performance of a breathing apparatus.

A second-stage pressure-reducing valve will be considered generally to be all the more pleasant for the user and better in performance as the depression required for obtaining a given rate of flow will be low. However, this type of equipment must be capable of satisfying the requirements of different types of users. When the users are professional divers, in particular when it concerns divers working under water and making physical efforts, it is desirable to arrange that these divers make a minimum inhaling effort to obtain the supply of breathing air. For this purpose, the opening of the valve must occur under a minimum depression. On the other hand, when this equipment is used in underwater diving schools, it is on the contrary necessary to arrange that the valve open under an increased depression, i.e. a large inhaling effort, so as to avoid an excessively strong assistance to said users. Further, depending on the depth at which the equipment is used, the air flow varies, namely it increases with the depth at which the diver is positioned.

Further, notwithstanding close manufacturing tolerances, a small difference in the mechanical characteristics of the elements controlling the valve of the breathing apparatus may result in a large difference in the inhaling effort on the part of the diver everything, else being equal.

SUMMARY OF THE INVENTION

The apparatus according to the invention solves the various problems referred to hereinbefore. For this purpose, the apparatus is characterised in that the conduit of the mouthpiece includes means constituting an obstacle to the free flow of the air from the expansion chamber to the mouth of the user, said means having such form that the depression required for opening the valve is between −6 millibars and +6 millibars for a rate of flow of 400 liters/minute.

Preferably, the means constituting an obstacle will be adjustable so as to create an inhaling effort which varies with the position of the obstacle means.

According to a preferred embodiment, said obstacle means will be formed by a tongue dividing the conduit into a first sub-conduit and a second sub-conduit.

Preferably, the end of the tongue located adjacent to the expansion chamber will be positioned to project into said chamber so as to create a pressure drop in the compressed gas stream issuing from the chamber toward the conduit. In order to still further improve this pressure drop, the valve, which is preferably formed by a movable valve member cooperative with its seat placed at the end of the pipe, will be surrounded by a cylindrical housing provided with an opening through which the gas issuing from the pipe escapes, this opening being oriented toward the projecting end of the tongue. This opening will be preferably placed in the vicinity of the conduit.

According to a second embodiment of the invention, the apparatus will comprise means for adjusting the position of the tongue in the conduit while the tongue remains parallel to itself.

According to a third embodiment of the invention, the tongue will be movable about an axis contained in its plane and substantially parallel to the end plane of the mouthpiece, said tongue including control means placed outside the mouthpiece for controlling the rotation of the latter in the conduit.

BRIEF DESCRIPTION OF THE DRAWING

A better understanding of the invention will be had from the following embodiments which are given by way of a nonlimiting example with reference to the accompanying drawings in which.

DETAILED DESCRIPTION OF THE PREFERRED EMBODIMENTS

Figure 1:
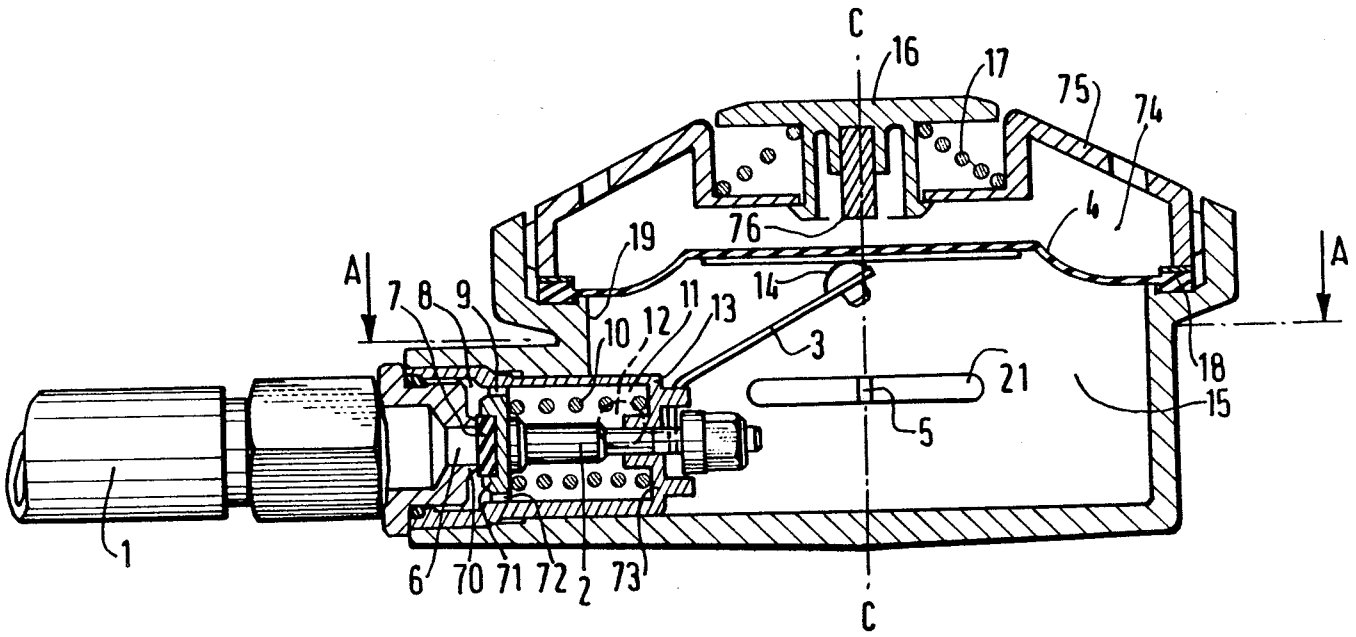
FIG. 1 is a sectional view of the breathing apparatus according to the invention.

FIG. 1 is a diagrammatic sectional view or the apparatus according to the invention. The apparatus comprises a flexible pipe 1 supplying compressed air to the apparatus according to the invention, commonly termed the second expansion stage of the breathing compressed air. This apparatus has a compressed gas inlet passage 6 whose end 70 constitutes the seat of a valve member 7 of the valve for the passage of the compressed air entering at medium pressure the expansion chamber 15 of this second stage. This valve member 7 is connected to a square plate 71 placed in a cylindrical housing 13. In this way, passageways 9 and 72 are defined between the sides of the plate 71 and the housing 13 which allow communication between the space 8 around the end of the gas inlet passage 6 and the space 11 inside the cylindrical housing 13. The latter terminates in an upper end 73 against which comes to bear a return spring 10 which biases the plate 71 and the valve member 7 against its seat 70. The plate 71 is connected to a pin 2 extending through the upper end 73 of the cylindrical housing 13 and connected to a lever 3 whose end 14 comes into contact with a membrane 4. The latter is fixed above the expansion chamber 15 by its peripheral edge portion 18 constituting a sealing element and thus divides the chamber 15 into an upper space 74 in which exists the surrounding fluid (i.e. the water when diving). This space 74 is defined by a cover 75 placed above the chamber 15 and in the centre of which is provided a push-button 16 which is biased to the position illustrated in FIG. 1 by a return spring 17. This push-button enables the apparatus to be actuated empty in the known manner by action of the lever 76 on the membrane 4 and the lever 3 which controls the opening of the valve. The cylindrical housing 13 includes in the vicinity of its end 73 an opening 12 whose axis 20 is oriented substantially toward the conduit 21 (see FIG. 2). The expansion chamber 15 has a vertical cylindrical wall 19 against which bears the air issuing from the opening 12 in the direction of the axis 20, this wall 19 conducting the compressed air toward the conduit 21. The latter includes in FIGS. 1 and 2 a tongue 5 which is disposed substantially in the middle of said conduit 21.

Figure 2:
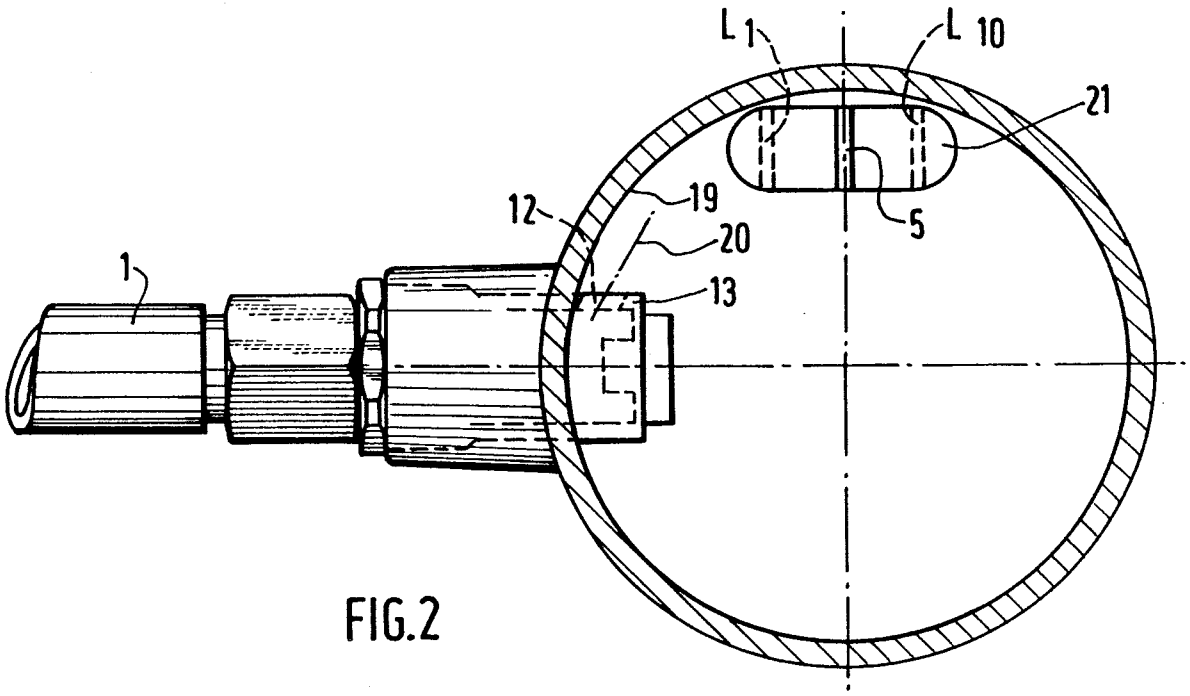
FIG. 2 is a sectional view taken on line A—A of the breathing apparatus of FIG. 1.

The device shown in FIGS. 1 and 2 operates in the following manner:

When the user, whose mouth is placed at the end of the mouthpiece 22 (see FIG. 3) makes an inhaling effort, a depression is created in the chamber 15. This depression causes the flexible membrane 4 to be displaced bearing in mind the fluid pressure prevailing in the space 74. The displacement of this membrane (downwardly as viewed in FIG. 1) causes the downward displacement of the lever 3 which causes the longitudinal displacement of the pin 2 in opposition to the force exerted by the return spring 10. The valve member 7 moves away from its seat 70 and allows the passage of compressed air, from the pipe 6, through the chamber 8, the passages 9, 72 and the space 11, this compressed air being ejected through the opening 12 toward the conduit 21 and consequently filling the chamber 15. When the user no longer makes an inhaling effort, the pressure in the chamber 15 becomes equal to the pressure in the space 74 and brings the membrane 4 to its stable position of equilibrium in which the lever 3 causes the closure of the valve member 7 onto its seat 70.

Figure 3:
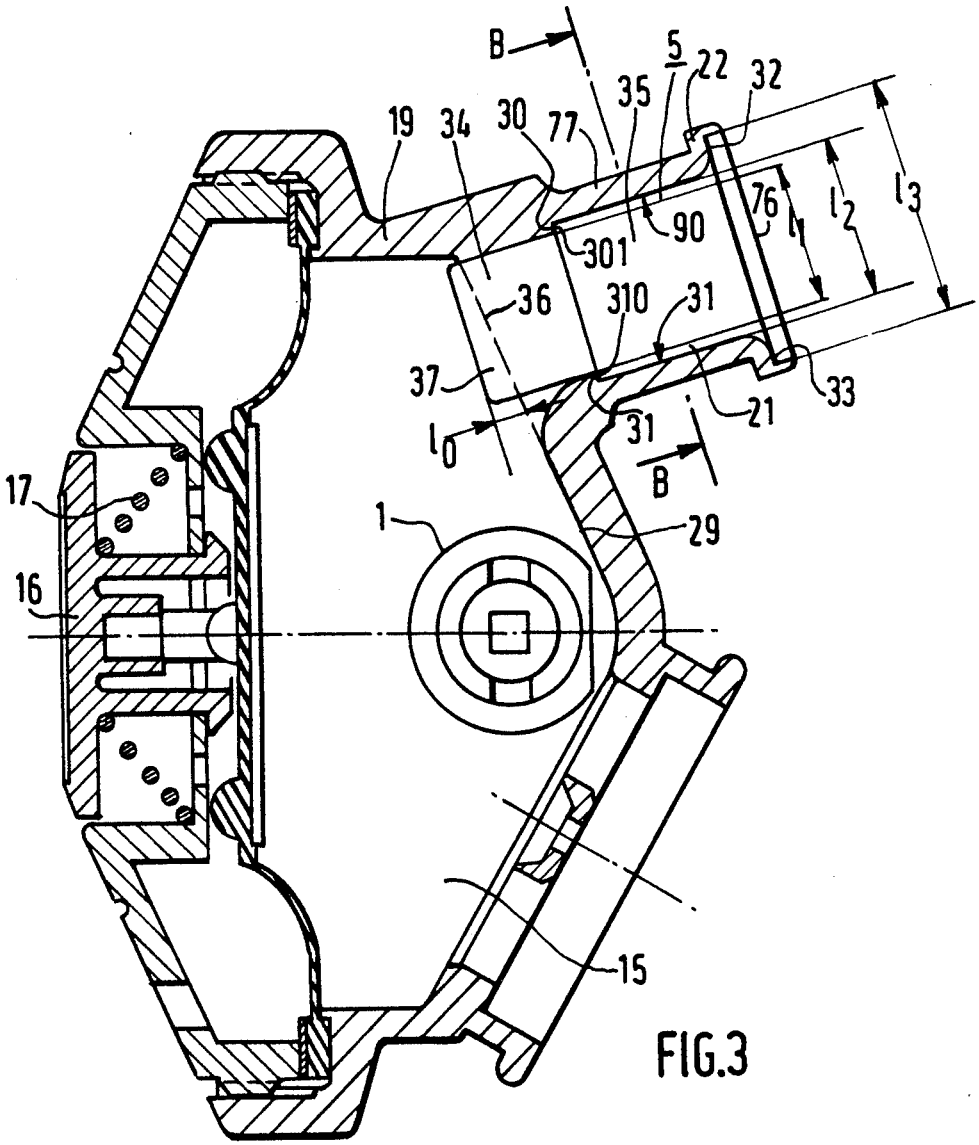
FIG. 3 is a sectional view taken on line C—C of the apparatus of FIG. 1.

FIG. 3 more specifically explains the function and operation of the tongue 5 in the conduit 21. This tongue 5 has a first portion 34 located adjacent to the expansion chamber 15, the upper end portion 37 of this tongue 5 projecting into the expansion chamber 15 to an extent $l_0$ defined by the extension of the lower wall 29 of the expansion chamber. The first rectangular portion 34 of the tongue 5, which has a width $l_1$, is extended by a second portion 35 which also has a substantially rectangular shape and a width $l_2$ larger than $l_1$. The junctions between the first and second portions 34 and 35 of the tongue 5 thus define abutments 301 and 310 which engage shoulders 30 and 31 located at the bottom of the adjustment grooves 38 and 39 (FIG. 4), The second portion 35 of the tongue 5 terminates in an enlarged portion defined by rounded portions 32 and 33 which are in contact with the walls of the mouthpiece 22. The edge 76 of the tongue 5 which is flush with the exterior of the mouthpiece 22 therefore has a width $l_3$ which is larger than $l_2$.

Figure 4:
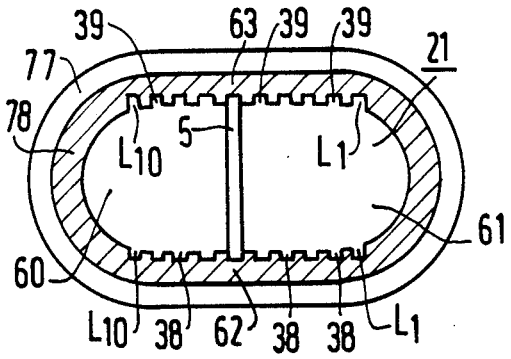
FIG. 4 is a sectional view of the apparatus of FIG. 3 in the region of the mouthpiece.

The adjustment and function of the tongue 5 are illustrated in FIG. 4 which is a sectional view taken on line B—B of the apparatus shown in FIG. 3. The conduit 21 is defined by an outer wall 77 which terminates inwardly in an inner wall 78. Ten lower grooves 38 and ten upper grooves 39 are provided on the two opposed parallel sides 62, 63 (which are horizontal in FIG. 4) of this inner wall 78. Each of these grooves has a position indicated by one of the reference characters $L_1$ to $L_{10}$. The reference character $L_1$ corresponding to the grooves 38 and 39 located at the right end of FIG. 4 while the reference character $L_{10}$ corresponds to the grooves 38 and 39 located at the left end of FIG. 4. The tongue 5 may therefore be adjusted in any one of ten positions $L_1, \ldots L_{10}$.

Whatever be the position of the tongue 5, the latter defines two sub-conduits 60 and 61 in the conduit 21. The position $L_1$ of the strip or tongue is the position corresponding in FIG. 2 to the tongue 5 placed in the vicinity of the opening 12 (the position which is the most to the left of FIG. 2).

Figure 8:
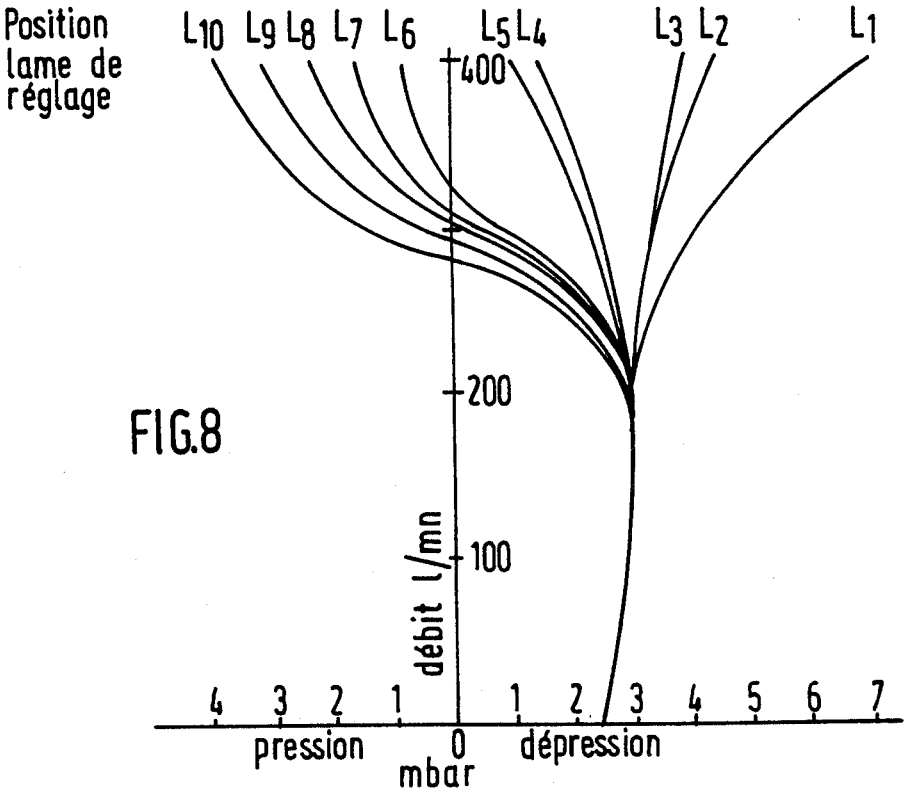
FIG. 8 is an illustration of curves representing the compressed air flow in litres/min as a function of the depression, for different positions of the regulating strip such as represented in FIG. 4.

FIG. 8 shows the results obtained with an apparatus such as that shown in the foregoing Figures. The illustrated curves of the flow of compressed air in liters/min as a function of the depression created by the user, show that the device in the presently-described embodiment has no effect up to a flow on the order of 200 liters/min (for an inhalation at atmospheric pressure). On the other hand, beyond 200 liters/min FIG. 8 shows the effect of the position of the tongue 5 in the conduit 21. When the tongue is at position $L_1$ (the position the most to the left in FIG. 2) the inhaling effort increases when the flow increases. The depression is on the order of 7 millibars for a flow of 400 liters/min, which involves a rather great effort when inhaling as the diver descends. At position $L_2$, the depression is substantially constant as at position $L_3$, which means that the inhaling effort of the diver will be the same irrespective of the depth at which he is located. From positions $L_4$ to $L_{10}$, it can be seen that the diver will have to provide upon each inhalation the work required to reach the flow of 300 liters/min, inhaling effort beyond this flow becoming nil. Of course, when the lungs of the diver are filled with air, the valve member 7 closes onto its seat 70.

Figure 5:
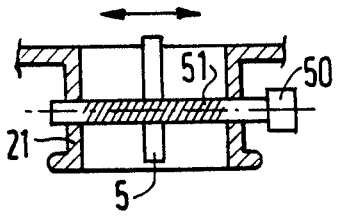
FIGS. 5, 6, 7 are modifications of the apparatus according to the invention.
Figure 6:
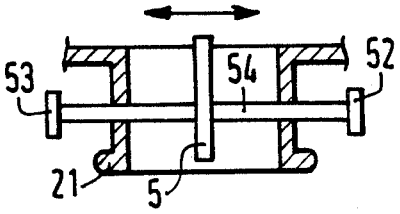
Figure 7:
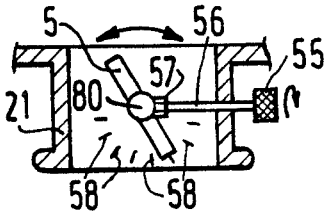

FIGS. 5, 6 and 7 represent modifications of the tongue shown in the proceeding Figures. In FIG. 5, it is arranged to shift the tongue in the conduit 21 while maintaining the tongue parallel to itself. For this purpose, the tongue 5 is connected to a screw 51 having at its right end, as viewed in FIG. 5, an actuating knob 50. The latter is located outside the mouthpiece and so positioned as to avoid hindering the diver when the mouthpiece is placed in the mouth of the latter. The diver can consequently shift the tongue 5 in one direction or the other by rotating the knob 50 in the required direction and thus increase or decrease the depression.

FIG. 6 shows a modification of the embodiment of FIG. 5 in which the tongue 5 is fixed to a pin 54 which is movable in translation across the mouthpiece 22 by two shifting handles 52 and 53 placed at each end of this pin 54. Preferably a number of stable positions of equilibrium are provided, such as steps, points of increased resistance, etc.

In the two embodiments shown in FIGS. 5 and 6, the tongue 5, as in the embodiment shown in FIGS. 1 to 4, can be arranged in projecting relation in the depression chamber 15 with the resulting advantages as concerns the pressure drop created by the projecting end portion of the tongue 5.

FIG. 7 shows a modification of the invention in which the tongue is shifted by rotating it about a pin 80 which is contained in the plane of the tongue and substantially parallel to the end plane of the mouthpiece, this tongue having control means placed outside the mouthpiece for controlling the rotation of the tongue in the conduit. The control means comprise a shaft 56, a control knob 55 and a gear system 57 of known type. Preferably, a certain number of stable positions of the tongue will be provided, such as the positions 58 (steps, points of increased resistance, etc.). This modification however does not have the advantage of the foregoing embodiments since, generally bearing in mind the dimensions and shape of the conduit 21 (see in particular FIG. 4), the tongue cannot be placed in a projecting position in the chamber 15. Further, beyond a certain position, a rotation through a few degrees produces a very large pressure drop which renders this embodiment more difficult to use.

What is claimed is:

1. In a compressed air breathing apparatus, in particular for underwater diving, comprising an expansion chamber for expanding the compressed air, compressed air supply means, a valve through which said compressed air supply means communicates with said chamber, means for controlling the opening and closing of said valve responsive to an inhaling effort on the part of the user, a mouthpiece including a conduit for putting said expansion chamber in communication with said mouthpiece and consequently the mouth of the user, said conduit including means for forming an obstacle to the free flow of the air from said expansion chamber to the mouth of the user, said obstacle means being so arranged that a depression required for opening said valve is between −6 millibar and +6 millibar for a rate of flow of air of 400 liters/min; the improvement comprising means for bodily shifting the position of said obstacle means while maintaining the shape of said obstacle means thereby to alter the inhaling effort required of the user according to the bodily shifted position of said obstacle means.

2. A breathing apparatus according to claim 1, comprising a plurality of pairs of opposed parallel grooves on two opposed walls of said conduit, said obstacle means having opposite parallel edges selectively insertable in any selected said pair of said grooves thereby bodily laterally to shift the position of said obstacle means in said conduit.

3. A breathing apparatus according to claim 2, wherein said obstacle means comprises a uniplanar tongue and each said groove has an abutment therein intermediate its length which engages with a shoulder on a said edge of said tongue intermediate the length of said edge, thereby to limit the depth of insertion of said tongue in said conduit.

4. A breathing apparatus according to claim 1, said obstacle means comprising a uniplanar tongue.

5. A breathing apparatus according to claim 4, wherein said tongue has an outer end that terminates in an enlargement that fits into a correspondingly enlarged portion of said mouthpiece.

6. A breathing apparatus according to claim 1, said shifting means maintaining said obstacle means at all times parallel to itself in all shifted positions thereof.

7. A breathing apparatus according to claim 6, in which said shifting means comprises a screw rotatable in said mouth piece and screw-threadedly engaged with said obstacle means.

8. A breathing apparatus according to claim 6, in which said shifting means comprises a pin extending into the mouthpiece and connected to the obstacle means, said pin having a portion extending outside the mouthpiece and shiftable in the lengthwise direction of the pin to shift the pin and the obstacle means within the mouthpiece.

9. A breathing apparatus according to claim 1, comprising means mounting said obstacle means within the mouthpiece for rotation about an axis that extends transverse to the direction of air flow through the mouthpiece, and means extending outside the mouthpiece to rotate said obstacle means about said axis.

* * * * *